US010566694B2

(12) United States Patent
Liou et al.

(10) Patent No.: US 10,566,694 B2
(45) Date of Patent: Feb. 18, 2020

(54) ANTENNA STRUCTURE AND WIRELESS COMMUNICATION DEVICE USING SAME

(71) Applicant: Chiun Mai Communication Systems, Inc., New Taipei (TW)

(72) Inventors: Geng-Hong Liou, New Taipei (TW); Yun-Jian Chang, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 161 days.

(21) Appl. No.: 15/810,246

(22) Filed: Nov. 13, 2017

(65) Prior Publication Data

US 2018/0159221 A1 Jun. 7, 2018

(30) Foreign Application Priority Data

Dec. 7, 2016 (CN) ..... 2016 1 1114590

(51) Int. Cl.

| | |
|---|---|
| ***H01Q 5/371*** | (2015.01) |
| ***H01Q 1/24*** | (2006.01) |
| ***H01Q 5/50*** | (2015.01) |
| ***H01Q 9/42*** | (2006.01) |
| ***H01Q 5/378*** | (2015.01) |

(52) U.S. Cl.

CPC ..... *H01Q 5/371* (2015.01); *H01Q 1/243* (2013.01); *H01Q 5/378* (2015.01); *H01Q 5/50* (2015.01); *H01Q 9/42* (2013.01)

(58) Field of Classification Search

CPC ..... H01Q 5/371; H01Q 5/378; H01Q 5/50; H01Q 1/243; H01Q 9/42

See application file for complete search history.

(56) References Cited

U.S. PATENT DOCUMENTS

| | | | | |
|---|---|---|---|---|
| 2007/0200771 | A1 | 8/2007 | Schack et al. | |
| 2010/0134358 | A1 | 6/2010 | Su et al. | |
| 2014/0118195 | A1 | 5/2014 | Chen et al. | |
| 2014/0354506 | A1 | 12/2014 | Lai et al. | |
| 2014/0375522 | A1* | 12/2014 | Lin | H01Q 1/243 343/853 |
| 2016/0156101 | A1 | 6/2016 | Tsai et al. | |

FOREIGN PATENT DOCUMENTS

| | | | |
|---|---|---|---|
| JP | 20100258544 | A | 11/2010 |
| JP | 20120227579 | A | 11/2012 |
| JP | 20140087050 | A | 5/2014 |
| JP | 20140236517 | A | 12/2014 |
| TW | 200905987 | A | 2/2009 |
| TW | 201244252 | A | 11/2012 |

* cited by examiner

*Primary Examiner* — Dameon E Levi
*Assistant Examiner* — David E Lotter
(74) *Attorney, Agent, or Firm* — ScienBiziP, P.C.

(57) ABSTRACT

A multi-frequency antenna structure includes a feed portion, a first ground portion, a first radiating portion, a second radiating portion, and a third radiating portion. The feed portion supplies current to the antenna structure. The first ground portion is spaced apart from the feed portion and grounds the antenna structure. The first radiating portion is electrically connected to the feed portion. The second radiating portion is spaced apart from the first radiating portion and is electrically connected to the first ground portion. The third radiating portion is spaced apart from the second radiating portion and is electrically connected to the feed portion and the first radiating portion.

20 Claims, 16 Drawing Sheets

ANTENNA STRUCTURE AND WIRELESS COMMUNICATION DEVICE USING SAME

CROSS-REFERENCE TO RELATED APPLICATIONS

This application claims priority to Chinese Patent Application No. 201611114590.6 filed on Dec. 7, 2016, the contents of which are incorporated by reference herein.

FIELD

The subject matter herein generally relates to an antenna structure and a wireless communication device using the antenna structure.

BACKGROUND

Wireless communication devices, such as mobile phones or personal digital assistants (PDAs), mainly use monopole antennas or inverted-F antennas. However, these antennas must have a corresponding keep-out-zone. Then, it is an important issue for people to design an antenna in a limited keep-out-zone, wherein the antenna has a low frequency band of about 704-960 MHz, a high frequency band of about 1710-2690 MHz, and has good radiation characteristics.

BRIEF DESCRIPTION OF THE DRAWINGS

Implementations of the present technology will now be described, by way of example only, with reference to the attached figures.

DETAILED DESCRIPTION

Figure 1:
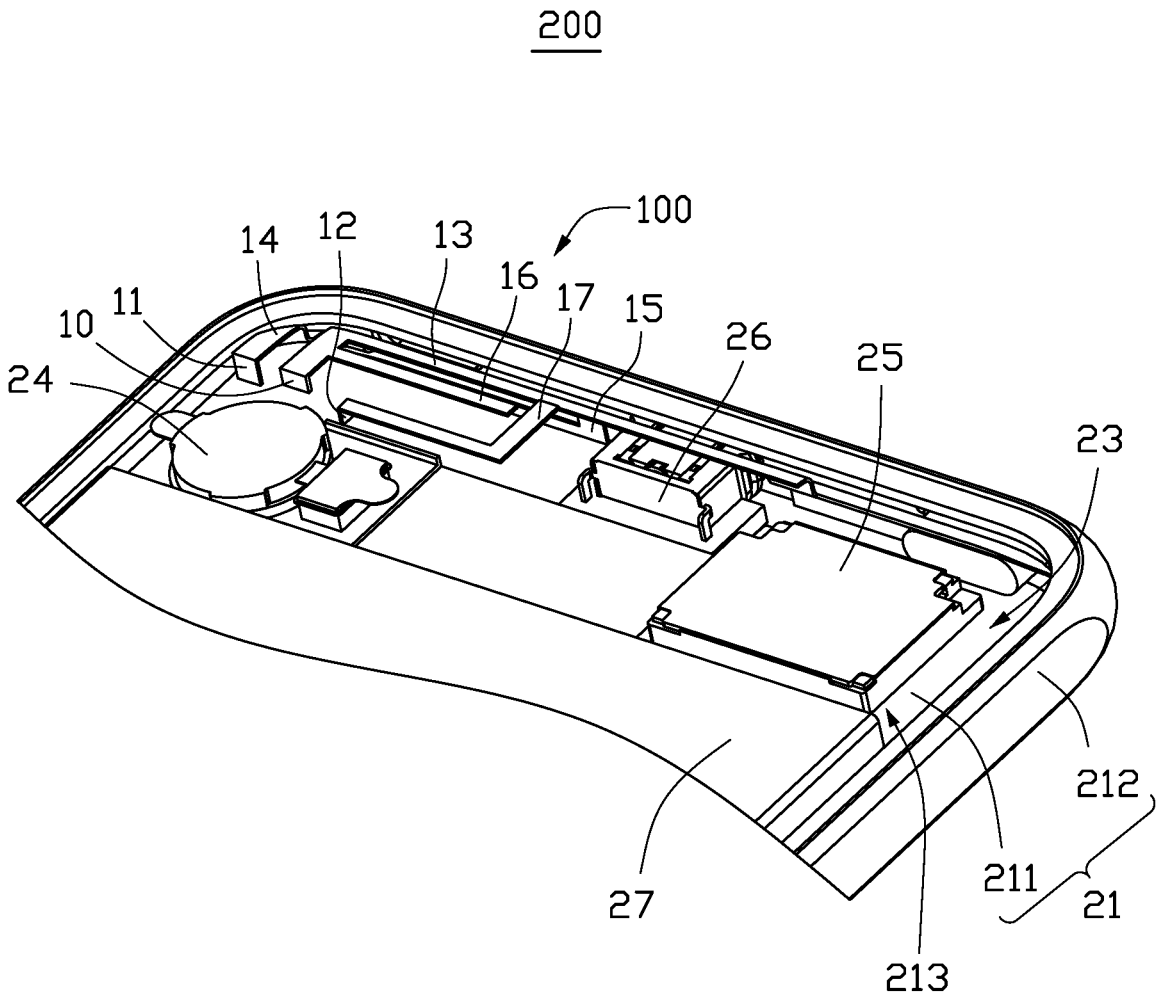
FIG. 1 is an isometric view of a first exemplary embodiment of a portion of a wireless communication device using a first exemplary antenna structure.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder. The term "comprising," when utilized, means "including, but not necessarily limited to"; it specifically indicates open-ended inclusion or membership in the so-described combination, group, series, and the like.

The present disclosure is described in relation to an antenna structure and a wireless communication device using same.

FIG. 1 illustrates an embodiment of a portion of a wireless communication device 200 using a first exemplary antenna structure 100. The wireless communication device 200 can be a mobile phone or a personal digital assistant, for example. The antenna structure 100 is configured to receive and/or send wireless signals.

The wireless communication device 200 further includes a housing 21 and a keep-out-zone 23. The housing 21 includes at least a bottom board 211 and a side frame 212. The side frame 212 is positioned around a periphery of the bottom board 211. The bottom board 211 and the side frame 212 cooperatively form a receiving space 213. The receiving space 213 can receive a print circuit board, a processing unit, or other electronic components or modules.

The keep-out-zone 23 is positioned at a side of the receiving space 213. The purpose of the keep-out-zone 23 is to delineate an area from which other electronic elements, such as a battery, a camera, a vibrator, a speaker, or a Charge Coupled Device (CCD) are excluded, to prevent the electronic element from interfering with the antenna structure 100. In this exemplary embodiment, the keep-out-zone 23 has dimensions of about 69.2*8.7 $mm^2$.

The wireless communication device 200 further includes at least one electronic element. In this exemplary embodiment, the wireless communication device 200 includes four electronic elements. The four electronic elements include a first electronic element 24, a second electronic element 25, a third electronic element 26, and a fourth electronic element 27. The first electronic element 24 and the second electronic element 25 are spaced apart from each other and are both adjacent to the keep-out-zone 23. The third electronic element 26 is positioned between the first electronic element 24 and the second electronic element 25. The third electronic element 26 is positioned above the keep-out-zone 23. The fourth electronic element 27 is positioned at one side of the first electronic element 24 and the second electronic element 25 away from the keep-out-zone 23.

In this exemplary embodiment, the first electronic element 24 is a vibrator. The second electronic element 25 is a speaker module. The third electronic element 26 is a Universal Serial Bus (USB) interface module. The fourth electronic element 27 is a battery.

The antenna structure 100 can be made of a metallic sheet or flexible printed circuit (FPC). The antenna structure 100 is positioned above the keep-out-zone 23. The antenna structure 100 includes a feed portion 10, a first ground portion 11, a second ground portion 12, a first radiating portion 13, a second radiating portion 14, a third radiating portion 15, a fourth radiating portion 16, and an extension portion 17.

The feed portion 10, the first ground portion 11, and the second ground portion 12 are all spaced apart from each other. The first radiating portion 13, the third radiating portion 15, and the fourth radiating portion 16 are all electrically connected to the feed portion 10. The second radiating portion 14 is spaced apart from the first radiating portion 13, the third radiating portion 15, the fourth radiating portion 16, and the extension portion 17. The second radiating portion 14 is electrically connected to the first ground portion 11. One end of the extension portion 17 is electrically connected to the first radiating portion 13. Another end of the extension portion 17 is electrically connected to the second ground portion 12.

Figure 2:
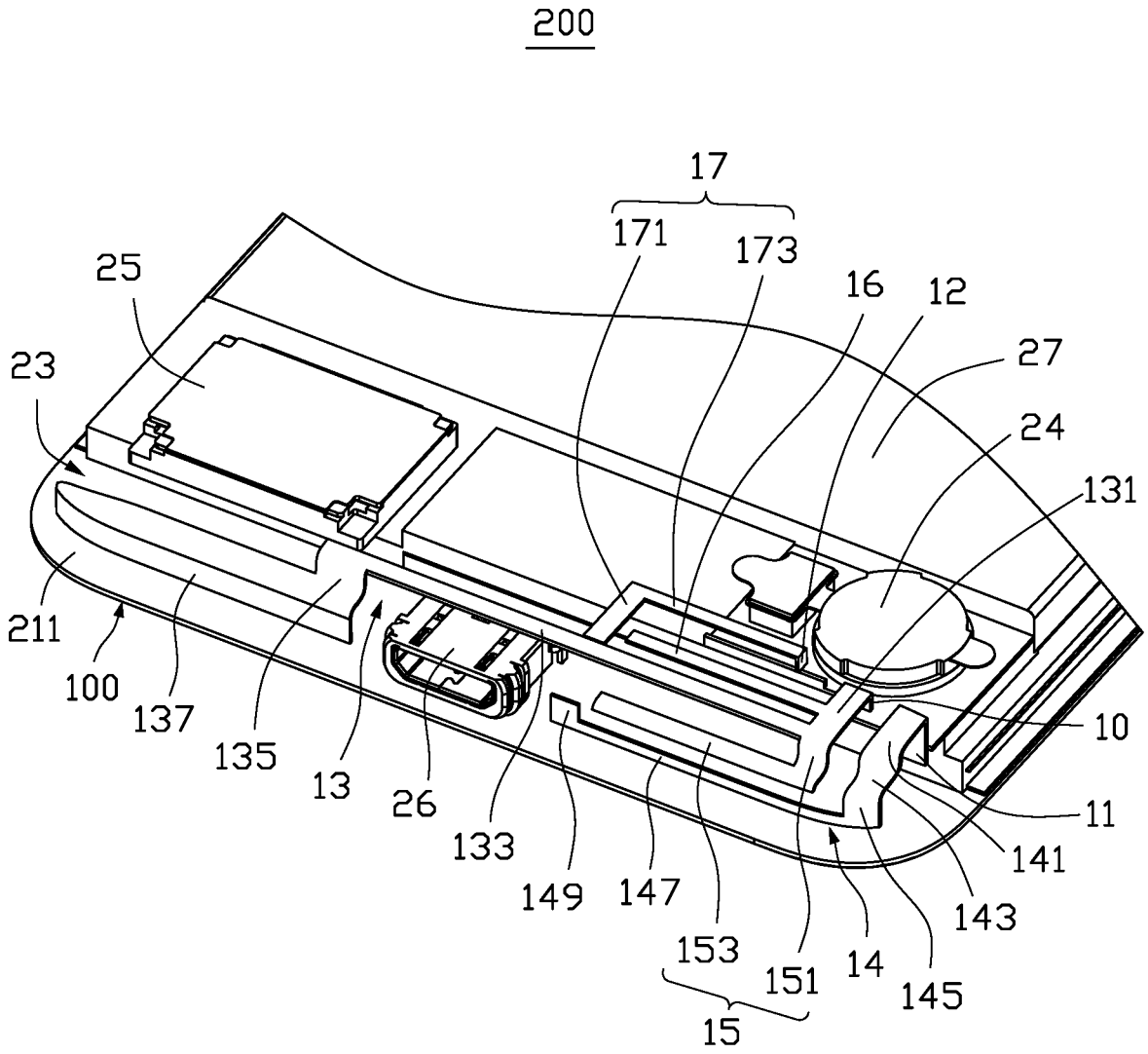
FIG. 2 is similar to FIG. 1, but shown from another angle.

As illustrated in FIG. 2, the feed portion 10 is substantially a strip. The feed portion 10 is positioned at a plane perpendicular to a plane on which the bottom board 211 is positioned. The feed portion 10 is positioned above the keep-out-zone 23 and is positioned adjacent to the first electronic element 24. The feed portion 10 is electrically connected to a feed source 28 (shown in FIG. 3) to feed current to the antenna structure 100.

The first ground portion 11 is substantially rectangular. The first ground portion 11 is positioned at a plane perpendicular to a plane on which the bottom board 211 is positioned. The first ground portion 11 is spaced apart from the feed portion 10. The first ground portion 11 is electrically connected to a ground point 29 (shown in FIG. 3) to ground the antenna structure 100. In this exemplary embodiment, the first ground portion 11 is longer than the feed portion 10.

The second ground portion 12 is substantially rectangular. The second ground portion 12 is positioned at a plane perpendicular to a plane on which the bottom board 211 is positioned. The second ground portion 12 is positioned at a side of the feed portion 10 away from the first ground portion 11 and is positioned adjacent to the first electronic element 24. The second ground portion 12 is electrically connected to the ground point 29 to ground the antenna structure 100.

The first radiating portion 13 includes a first radiating section 131, a second radiating section 133, a third radiating section 135, and a fourth radiating section 137. The first radiating section 131 is substantially rectangular. The first radiating section 131 is positioned at a plane parallel to a plane on which the bottom board 211 is positioned. The first radiating section 131 is electrically connected to one end of the feed portion 10 away from the bottom board 211 and extends along a direction away from the first electronic element 24.

The second radiating section 133 is substantially rectangular. The second radiating section 133 is coplanar with the first radiating section 131. One end of the second radiating section 133 is perpendicularly connected to one end of the first radiating section 131 away from the feed portion 10 and extends along a direction away from the first electronic element 24 and the second radiating portion 14. The extension continues until the second radiating section 133 passes over the third electronic element 26 and extends along a direction away from the first electronic element 24 and towards the second electronic element 25. The extension continues until a distal end of the second radiating section 133 is substantially collinear with one side of the second electronic element 25 adjacent to the first electronic element 24.

One end of the third radiating section 135 forms a curved connection with one end of the second radiating section 133 away from the first radiating section 131. Another end of the third radiating section 135 extends along a direction parallel to the feed portion 10 and towards the bottom board 211, then extends along a direction parallel to the second radiating section 133 and away from the first radiating section 131 and the second radiating section 133. The extension continues until the third radiating section 135 passes over the second electronic element 25.

The fourth radiating section 137 is substantially rectangular. The fourth radiating section 137 is positioned at a plane perpendicular to a plane on which the second radiating section 133 is positioned. One end of the fourth radiating section 137 forms a curved connection with one end of the third radiating section 135 away from the second radiating section 133. Another end of the fourth radiating section 137 extends along a direction towards the bottom board 211.

The second radiating portion 14 includes a first coupling arm 141, a second coupling arm 143, a third coupling arm 145, a fourth coupling arm 147, and a fifth coupling arm 149, connected in that order. The first coupling arm 141 is substantially rectangular. The first coupling arm 141 is coplanar with the first radiating section 131. The first coupling arm 141 is perpendicularly connected to one end of the first ground portion 11 away from the bottom board 211 and extends along a direction parallel to the first radiating section 131 and away from the first electronic element 24.

One end of the second coupling arm 143 forms a curved connection with one end of the first coupling arm 141 away from the first ground portion 11. Another end of the second coupling arm 143 extends along a direction parallel to the third radiating section 135 and towards the bottom board 211.

The third coupling arm 145, the fourth coupling arm 147, the fifth coupling arm 149, and the fourth radiating section 137 are coplanar with each other. The third coupling arm 145 is substantially rectangular. One end of the third coupling arm 145 forms a curved connection with one end of the second coupling arm 143 away from the first coupling arm 141 and extends along a direction parallel to the fourth radiating section 137 and towards the bottom board 211.

The fourth coupling arm 147 is substantially rectangular. The fourth coupling arm 147 is perpendicularly connected to one end of the third coupling arm 145 away from the second coupling arm 143. The fifth coupling arm 149 is substantially rectangular. The fifth coupling arm 149 is perpendicularly connected to one end of the fourth coupling arm 147 away from the third coupling arm 145 and extends along a direction parallel to the third coupling arm 145 and towards the second radiating section 133. The third coupling arm 145, the fourth coupling arm 147, and the fifth coupling arm 149 cooperatively form a U-shaped structure.

The third radiating portion 15 includes a first radiating arm 151 and a second radiating arm 153. One end of the first radiating arm 151 forms a curved connection with a junction of the first radiating section 131 and the second radiating section 133. Another end of the first radiating arm 151 extends along a direction parallel to the second coupling arm 143 and towards the bottom board 211.

The second radiating arm 153 is substantially rectangular. The second radiating arm 153 is positioned at a plane parallel to a plane on which the second radiating section 133 is positioned. One end of the second radiating arm 153 is perpendicularly connected to one end of the first radiating arm 151 away from the first radiating section 131. Another end of the second radiating arm 153 extends along a direction parallel to the second radiating section 133 and towards the second electronic element 25. In this exemplary embodiment, the second radiating arm 153 is shorter than the second radiating section 133. A U-shaped structure formed by the third coupling arm 145, the fourth coupling arm 147, and the fifth coupling arm 149 surrounds the third radiating portion 15.

The fourth radiating portion 16 is substantially rectangular. The fourth radiating portion 16 is coplanar with the first radiating section 131. One end of the fourth radiating portion 16 is perpendicularly connected to one side of the first radiating section 131 adjacent to the second radiating section 133 and away from the first coupling arm 141. Another end of the fourth radiating portion 16 extends along a direction parallel to the second radiating section 133 and towards the second electronic element 25. In this exemplary embodiment, the fourth radiating portion 16 and the second radiating section 133 are both positioned at a same side of the first radiating section 131 away from the first coupling arm 141. The fourth radiating portion 16 is shorter than the second radiating section 133. A length of the fourth radiating portion 16 is substantially equal to a length of the second radiating arm 153.

The extension portion 17 is substantially L-shaped. The extension portion 17 includes a first extension section 171 and a second extension section 173. The first extension section 171 is substantially rectangular. The first extension section 171 is coplanar with the first radiating section 131. The first extension section 171 is perpendicularly connected to a middle portion of one side of the second radiating section 133 and extends along a direction parallel to the first radiating section 131 and towards the first electronic element 24.

The second extension section 173 is substantially rectangular. The second extension section 173 is coplanar with the first extension section 171. One end of the second extension section 173 is perpendicularly connected to one end of the first extension section 171 away from the second radiating section 133. Another end of the second extension section 173 extends along a direction parallel to the second radiating section 133 and towards the first radiating section 131. The extension continues until the second extension section 173 is perpendicularly connected to one end of the second ground portion 12 away from the bottom board 211.

In this exemplary embodiment, the first extension section 171 is longer than the first radiating section 131. The fourth radiating portion 16 is positioned between the second radiating section 133 and the second extension section 173. That is, the second radiating section 133 and the extension portion 17 cooperatively surround the fourth radiating portion 16.

Figure 3:
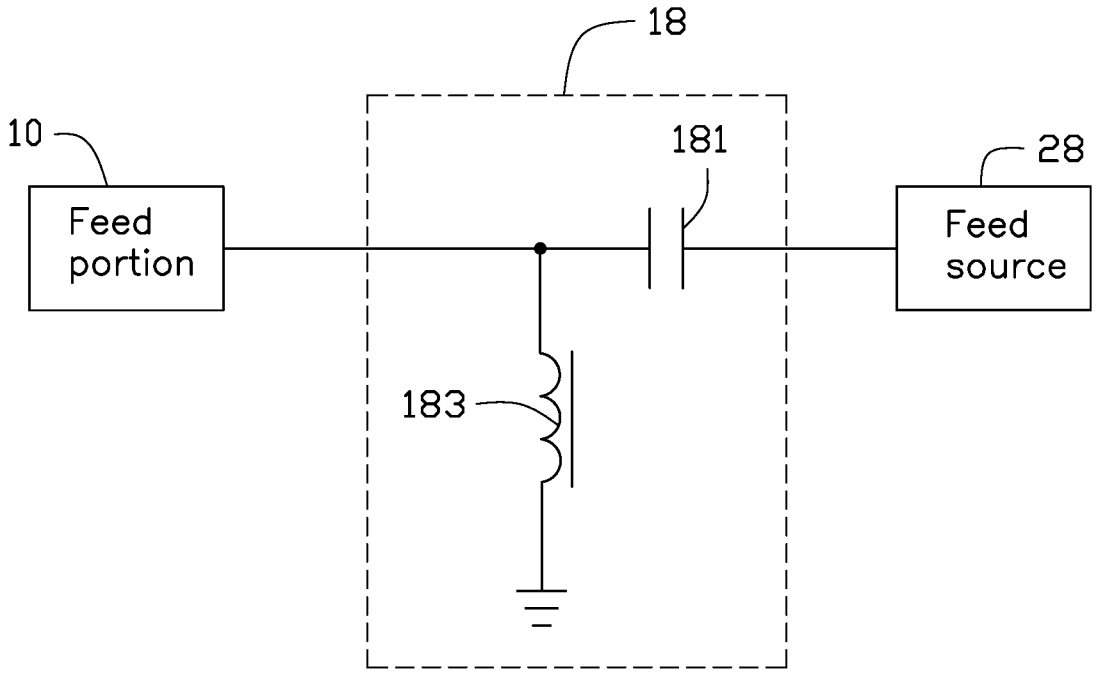
FIG. 3 is a circuit diagram of a matching circuit of the antenna structure of FIG. 1.

As illustrated in FIG. 3, in this exemplary embodiment, the antenna structure 100 further includes a matching circuit 18. One end of the matching circuit 18 is electrically connected to the feed source 28. Another end of the matching circuit 18 is electrically connected to the feed portion 10. The matching circuit 18 includes a first matching element 181 and a second matching element 183. One end of the first matching element 181 is electrically connected to the feed source 28. Another end of the first matching element 181 is electrically connected to one end of the second matching element 183 and the feed portion 10. Another end of the second matching element 183 is grounded.

In this exemplary embodiment, the first matching element 181 is a capacitor having a capacitance value of about 2.5 pF. The second matching element 183 is an inductor having an inductance value of about 8 nH. In other exemplary embodiments, the first matching element 181 can be an inductor or a combination of inductor and capacitor. The second matching element 183 can be a capacitor or the combination.

Figure 4:
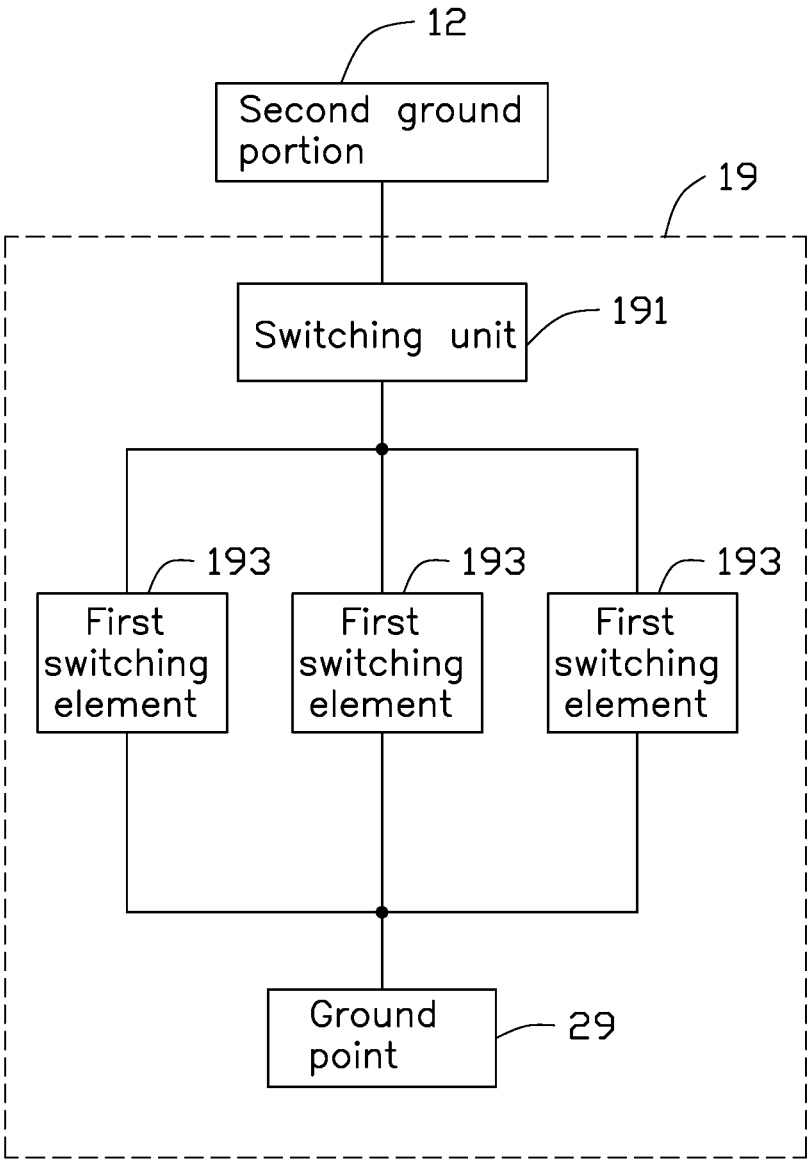
FIG. 4 is a circuit diagram of a switching circuit of the antenna structure of FIG. 1.

As illustrated in FIG. 4, in this exemplary embodiment, the antenna structure 100 further includes a switching circuit 19. One end of the switching circuit 19 is electrically connected to the second ground portion 12. Another end of the switching circuit 19 is electrically connected to the ground point 29 to be grounded.

The switching circuit 19 includes a switching unit 191 and a plurality of first switching elements 193. In this exemplary embodiment, the switching circuit 19 includes three first switching elements 193. The three first switching elements 193 are all inductors and have respective inductance values of about 6.2 nH, 12 nH, and 16 nH. The switching unit 191 is electrically connected to the second ground portion 12. The first switching elements 193 are connected in parallel. One end of each first switching element 193 is electrically connected to the switching unit 191. The other end of each first switching element 193 is electrically connected to the ground point 29 to be grounded.

Through controlling the switching unit 191, the second ground portion 12 can be switched to connect with different first switching elements 193. Since each first switching element 193 has a different inductance value, a low frequency band of the antenna structure 100 is adjustable through switching the switching unit 191.

For example, when the switching unit 191 switches to connect with a first switching element 193 having an inductance value of about 6.2 nH, the antenna structure 100 can work at frequency bands of LTE-A Band 5 (869-894 MHz) and LTE-A Band 8 (925-926 MHz). When the switching unit 191 switches to connect with a first switching element 193 having an inductance value of about 12 nH, the antenna structure 100 can work at a frequency band of LTE-A Band 20 (791-826 MHz). When the switching unit 191 switches to connect with a first switching element 193 having an inductance value of about 16 nH, the antenna structure 100 can work at a frequency band of LTE-A Band 17 (704-746 MHz).

In other exemplary embodiments, the first switching elements 193 are not limited to being inductors, and can be capacitors or a combination of inductor and capacitor. The number of the first switching elements 193 is also adjustable.

When the feed portion 10 supplies current, the current flows to the first radiating portion 13, the third radiating portion 15, the fourth radiating portion 16, and the extension portion 17, and is grounded through the second ground portion 12. The current from the first radiating section 131 is further coupled to the second radiating portion 14 and is grounded through the first ground portion 11. Then the first radiating portion 13 activates a low frequency operation mode. The second radiating portion 14 activates a first mode of a middle and high frequency band. A frequency-doubling of the first radiating portion 13 activates a second mode of the middle and high frequency band. The fourth radiating portion 16 activates a third mode of the middle and high frequency band. The third radiating portion 15 adjusts the first mode and the third mode of the middle and high frequency band. The antenna structure 100 includes the switching circuit 19 to adjust the low frequency mode of the antenna structure 100.

As described above, a low frequency operation mode of the antenna structure 100 is adjustable through the switching circuit 19. When the low frequency band of the antenna structure 100 is adjusted, a middle and high frequency band of the antenna structure 100 still maintains a wideband frequency and satisfies a design of Carrier Aggregation (CA) technology of LTE-Advanced. Additionally, the switching circuit 19 is positioned at the second ground portion 12 to effectively reduce losses in the feed portion 12.

Figure 5:
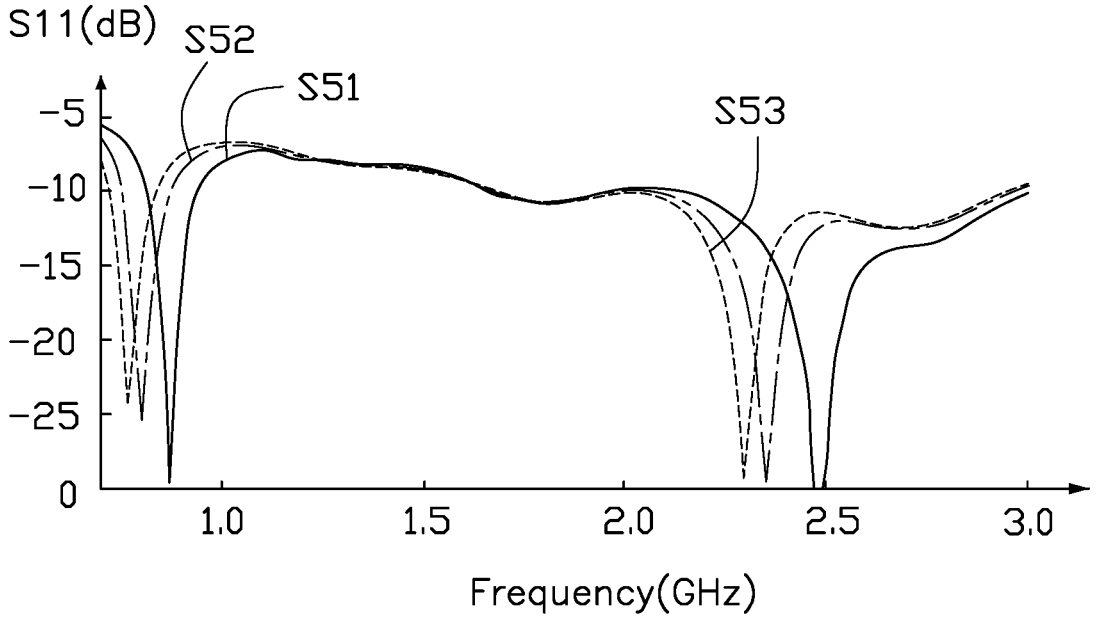
FIG. 5 is a scattering parameter graph of the antenna structure of FIG. 1.

FIG. 5 illustrates a scattering parameter graph of the antenna structure 100. Curve S51 illustrates a scattering parameter of the antenna structure 100 when the switching circuit 19 switches to a first switching element 193 having an inductance value of about 6.2 nH. Curve S52 illustrates a scattering parameter of the antenna structure 100 when the switching circuit 19 switches to a first switching element 193 having an inductance value of about 12 nH. Curve S53 illustrates a scattering parameter of the antenna structure 100 when the switching circuit 19 switches to a first switching element 193 having an inductance value of about 16 nH.

Referring to curves S51-S53, when the switching circuit 19 switches to different first switching elements 193, the antenna structure 100 can work at different low frequency bands. For example, a frequency band of LTE-A Band 5 (869-894 MHz), a frequency band of LTE-A Band 8 (925-926 MHz), a frequency band of LTE-A Band 20 (791-862 MHz), and a frequency band of LTE-A Band 17 (704-746 MHz). Additionally, the antenna structure 100 can by design work at a high frequency band, for example, GSM1800/1900, UMTS 2100, and LTE-A Band 7.

The second mode of the middle and high frequency bands of the antenna structure 100 is activated by a frequency-doubling of the first radiating portion 13. When the antenna structure 100 adjusts to the low frequency operation mode through the switching circuit 19, the second mode of the middle and high frequency band of the antenna structure 100 is also adjustable. That is, when the antenna structure 100 adjusts to the low frequency operation mode through the switching circuit 19, the switching circuit 19 only affects the second mode of the middle and high frequency bands to maintain wideband characteristics of these middle and high frequency bands.

Figure 6:
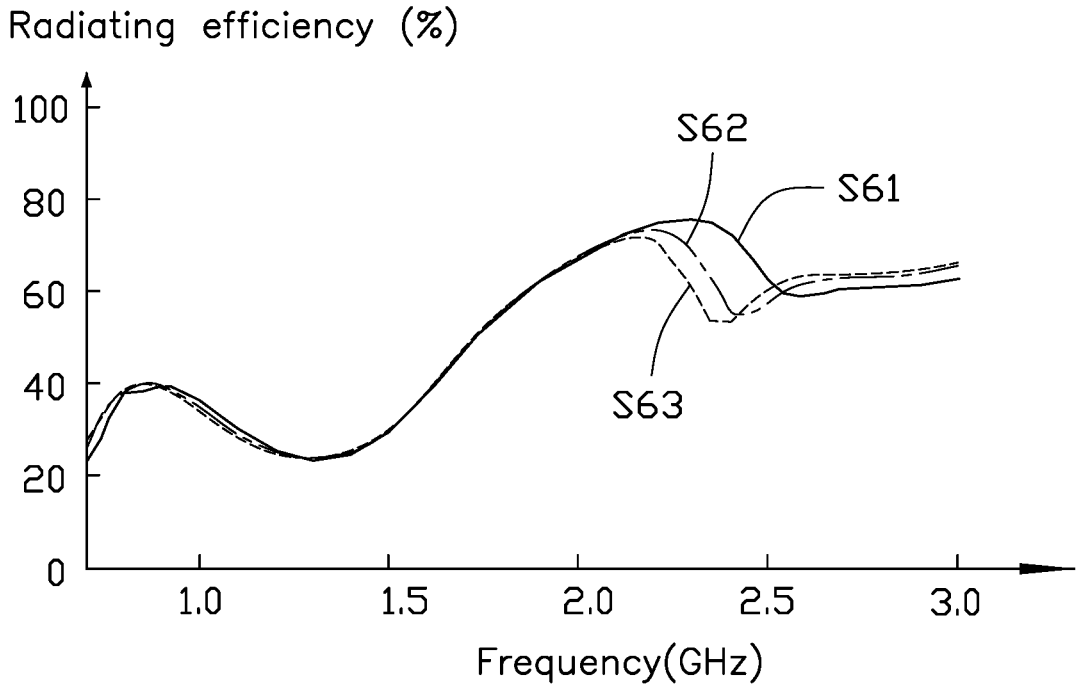
FIG. 6 is a radiating efficiency graph of the antenna structure of FIG. 1.

FIG. 6 illustrates a radiating efficiency graph of the antenna structure 100. Curve S61 illustrates a radiating efficiency of the antenna structure 100 when the switching circuit 19 switches to a first switching element 193 having an inductance value of about 6.2 nH. Curve S62 illustrates a radiating efficiency of the antenna structure 100 when the switching circuit 19 switches to a first switching element 193 having an inductance value of about 12 nH. Curve S63 illustrates a radiating efficiency of the antenna structure 100 when the switching circuit 19 switches to a first switching element 193 having an inductance value of about 16 nH.

Figure 7:
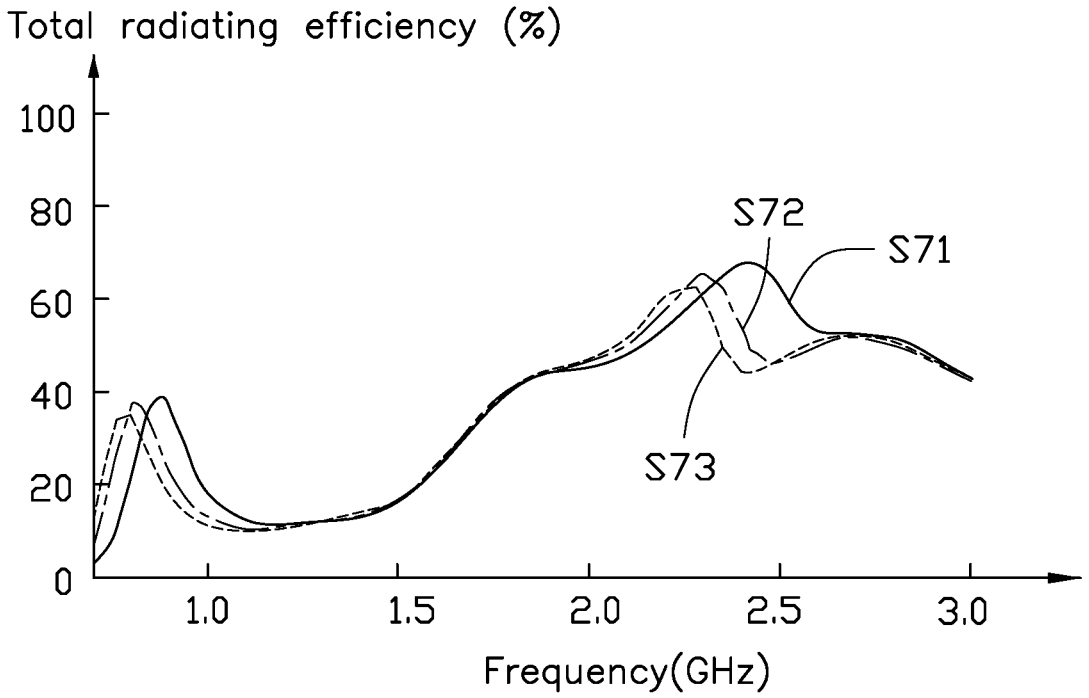
FIG. 7 is a total radiating efficiency graph of the antenna structure of FIG. 1.

FIG. 7 illustrates a total radiating efficiency graph of the antenna structure 100. Curve S71 illustrates a total radiating efficiency of the antenna structure 100 when the switching circuit 19 switches to a first switching element 193 having an inductance value of about 6.2 nH. Curve S72 illustrates a total radiating efficiency of the antenna structure 100 when the switching circuit 19 switches to a first switching element 193 having an inductance value of about 12 nH. Curve S73 illustrates a total radiating efficiency of the antenna structure 100 when the switching circuit 19 switches to a first switching element 193 having an inductance value of about 16 nH.

FIG. 6 and FIG. 7 show that, through switching of the switching circuit 19, the antenna structure 100 can completely cover a system bandwidth required by multiple communication systems. For example, a low frequency band of the antenna structure 100 can cover 700-960 MHz and a middle and high frequency band of the antenna structure 100 can cover 1710-2170 MHz. The antenna structure 100 also has a good radiating efficiency. For example, a radiating efficiency and a total radiating efficiency of the antenna structure 100 at the low frequency band are about 30-38%. A radiating efficiency and a total radiating efficiency of the antenna structure 100 at the middle and high frequency bands are about 43-65%.

Figure 8:
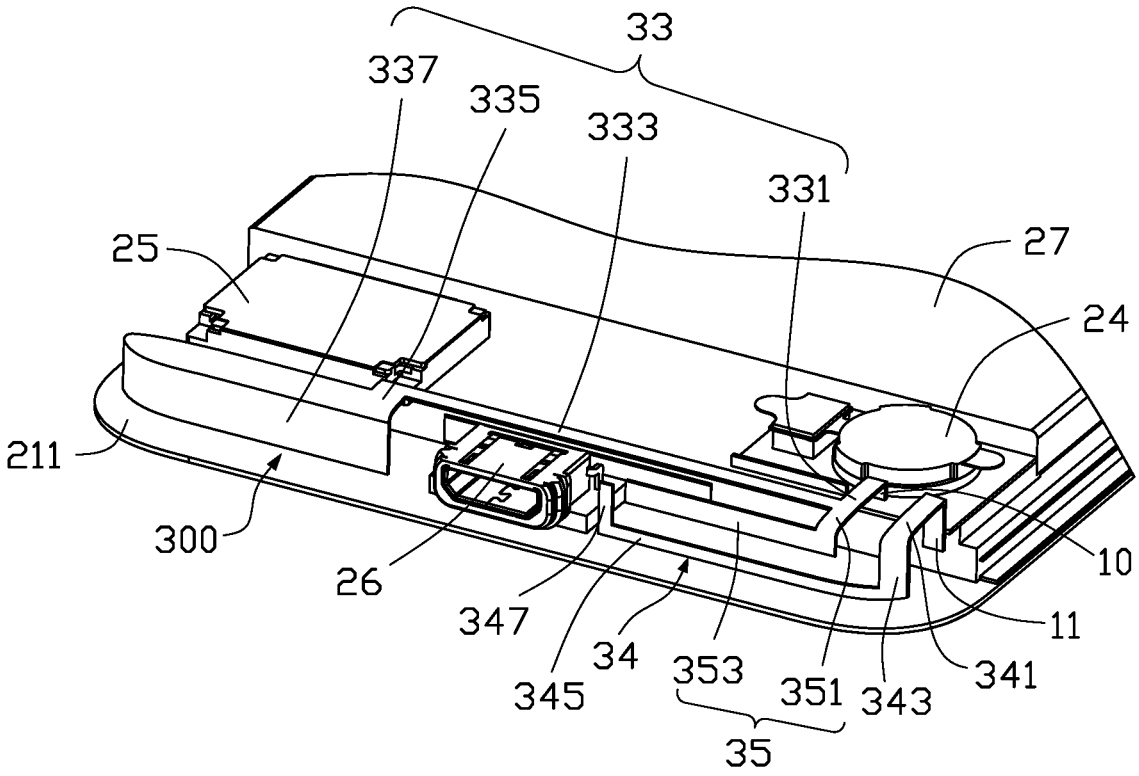
FIG. 8 is an isometric view of a second exemplary embodiment of an antenna structure.
Figure 9:
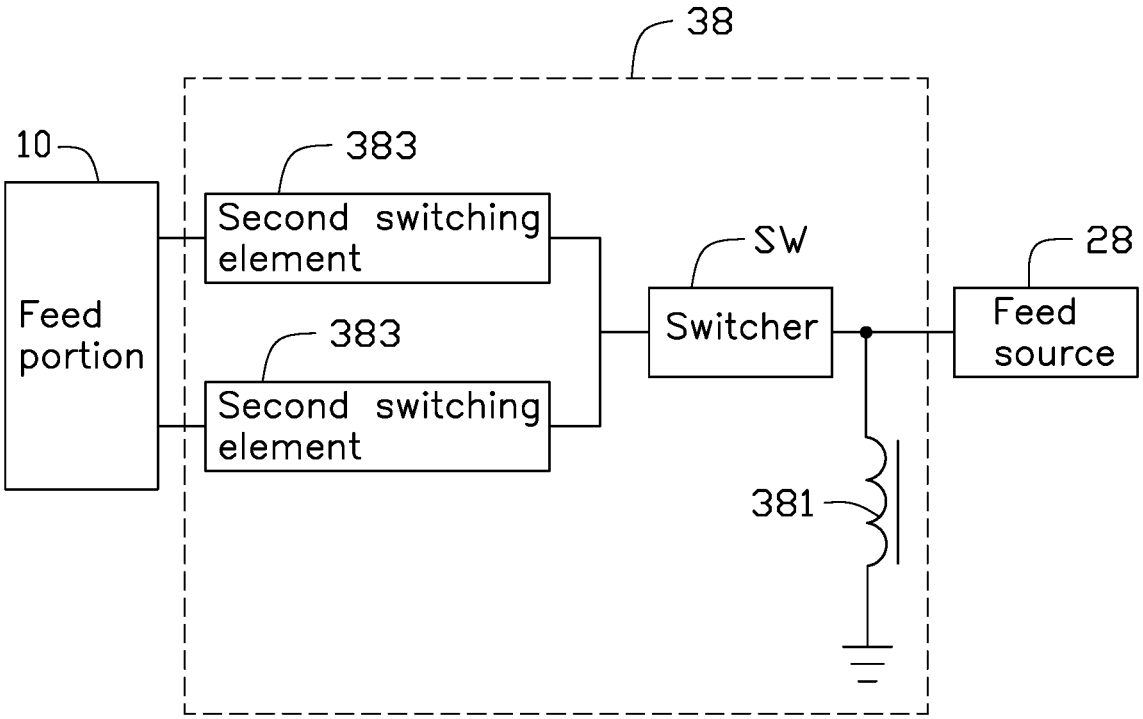
FIG. 9 is a circuit diagram of a matching circuit of the antenna structure of FIG. 8.

FIGS. 8-9 illustrate a second exemplary embodiment of an antenna structure 300. The antenna structure 300 includes a feed portion 10, a first ground portion 11, a first radiating portion 33, a second radiating portion 34, a third radiating portion 35, and a matching circuit 38. The antenna structure 300 differs from the antenna structure 100 in that the antenna structure 300 does not include the second ground portion 12, the fourth radiating portion 16, the extension portion 17, and the switching circuit 19 of the antenna structure 100. That is, the second ground portion 12, the fourth radiating portion 16, the extension portion 17, and the switching circuit 19 of the antenna structure 100 are all omitted. Additionally, structures of the first radiating portion 33, the second radiating portion 34, the third radiating portion 35, and the matching circuit 38 are respectively different from the structures of the first radiating portion 13, the second radiating portion 14, the third radiating portion 15, and the matching circuit 18 of the antenna structure 100.

In detail, the first radiating portion 33 includes a first radiating section 331, a second radiating section 333, a third radiating section 335, and a fourth radiating section 337. The first radiating section 331 is substantially rectangular. The first radiating section 331 is positioned at a plane parallel to a plane on which the bottom board 211 is positioned. The first radiating section 331 is electrically connected to one end of the feed portion 10 away from the bottom board 211 and extends along a direction away from the first electronic element 24.

The second radiating section 333 is substantially rectangular. The second radiating section 333 is coplanar with the first radiating section 331. One end of the second radiating section 333 is perpendicularly connected to one end of the first radiating section 331 away from the feed portion 10 and extends along a direction away from the first electronic element 24 and the second radiating portion 34. The extension continues until the second radiating section 333 passes over the third electronic element 26 and extends along a direction away from the first electronic element 24 and towards the second electronic element 25. The extension continues until a distal end of the second radiating section 333 is substantially collinear with one side of the second electronic element 25 adjacent to the first electronic element 24.

The third radiating section 335 is coplanar with the first radiating section 331 and the second radiating section 333. One end of the third radiating section 335 is perpendicularly connected to one end of the second radiating section 333 away from the first radiating section 331. Another end of the third radiating section 335 extends along a direction parallel to and away from the first radiating section 331, then extends along a direction parallel to the second radiating section 333 and away from the first radiating section 331. The extension continues until the third radiating section 335 passes over the second electronic element 25.

The fourth radiating section 337 is substantially rectangular. The fourth radiating section 337 is positioned at a plane perpendicular to a plane on which the second radiating section 333 is positioned. One end of the fourth radiating section 337 is perpendicularly connected to one end of the third radiating section 335 away from the second radiating section 333. Another end of the fourth radiating section 337 extends along a direction towards the bottom board 211.

The second radiating portion 34 includes a first coupling arm 341, a second coupling arm 343, a third coupling arm 345, and a fourth coupling arm 347 connected in that order. The first coupling arm 341 is substantially rectangular. The first coupling arm 341 is coplanar with the first radiating section 331. The first coupling arm 341 is perpendicularly connected to one end of the first ground portion 11 away from the bottom board 211 and extends along a direction parallel to the first radiating section 331 and away from the first electronic element 24.

The second coupling arm 343 is coplanar with the fourth radiating section 337. One end of the second coupling arm 143 is perpendicularly connected to one end of the first coupling arm 341 away from the first ground portion 11. Another end of the second coupling arm 343 extends along a direction towards the bottom board 211.

The third coupling arm 345 is substantially rectangular. One end of the third coupling arm 345 is perpendicularly connected to one end of the second coupling arm 343 away from the first coupling arm 341 and extends along a direction towards the fourth radiating section 137.

The fourth coupling arm 347 is substantially rectangular. One end of the fourth coupling arm 347 is perpendicularly connected to one end of the third coupling arm 345 away from the second coupling arm 343. Another end of the fourth coupling arm 347 extends along a direction parallel to the second coupling arm 343 and towards the second radiating section 333. Then, the second coupling arm 343, the third coupling arm 345, and the fourth coupling arm 347 cooperatively form a U-shaped structure.

The third radiating portion 35 includes a first radiating arm 351 and a second radiating arm 353. The first radiating arm 351 is coplanar with the first radiating section 331. One end of the first radiating arm 351 is perpendicularly connected to a junction of the first radiating section 331 and the second radiating section 333. Another end of the first radiating arm 351 extends along a direction parallel to the first coupling arm 341 and away from the first radiating section 331.

The second radiating arm 353 is substantially rectangular. The second radiating arm 353 is positioned at a plane parallel to a plane on which the fourth radiating section 337 is positioned. One end of the second radiating arm 353 is perpendicularly connected to one end of the first radiating arm 351 away from the first radiating section 331. Another end of the second radiating arm 353 extends along a direction parallel to the third coupling arm 345 and towards the second electronic element 25.

As illustrated in FIG. 9, in this exemplary embodiment, the matching circuit 38 of the antenna structure 300 includes a first matching element 381, a switcher SW, and a plurality of second switching elements 383. In this exemplary embodiment, the matching circuit 38 includes two second switching elements 383. The two second switching elements 383 are both capacitors and have capacitance values of about 4 pF and 14 pF, respectively. The first matching element 381 is an inductor and has an inductance value of about 8 nH.

One end of the first matching element 381 is electrically connected to the feed source 28 and one end of the switcher S2. Another end of the first matching element 381 is grounded. The two second switching elements 383 are connected in parallel. One end of each second switching element 383 is electrically connected to another end of the switcher SW. The other end of each second switching element 383 is electrically connected to the feed portion 10.

Through controlling the switcher SW, the feed portion 10 can be switched to connect with different second switching elements 383. Since each second switching element 383 has a different capacitance value, a low frequency band of the antenna structure 300 is adjustable through switching the switcher SW.

For example, when the switcher SW switches to connect with a second switching element 383 having a capacitance value of about 4 pF, the antenna structure 300 can work at a frequency band of about 900 MHz. When the switcher SW switches to connect with a second switching element 383 having a capacitance value of about 14 pF, the antenna structure 300 can work at a frequency band of about 700 MHz. In other exemplary embodiments, the second switching elements 383 are not limited to being capacitors, and can be inductors or a combination of inductor and capacitor. The number of the second switching elements 383 is also adjustable.

Figure 10:
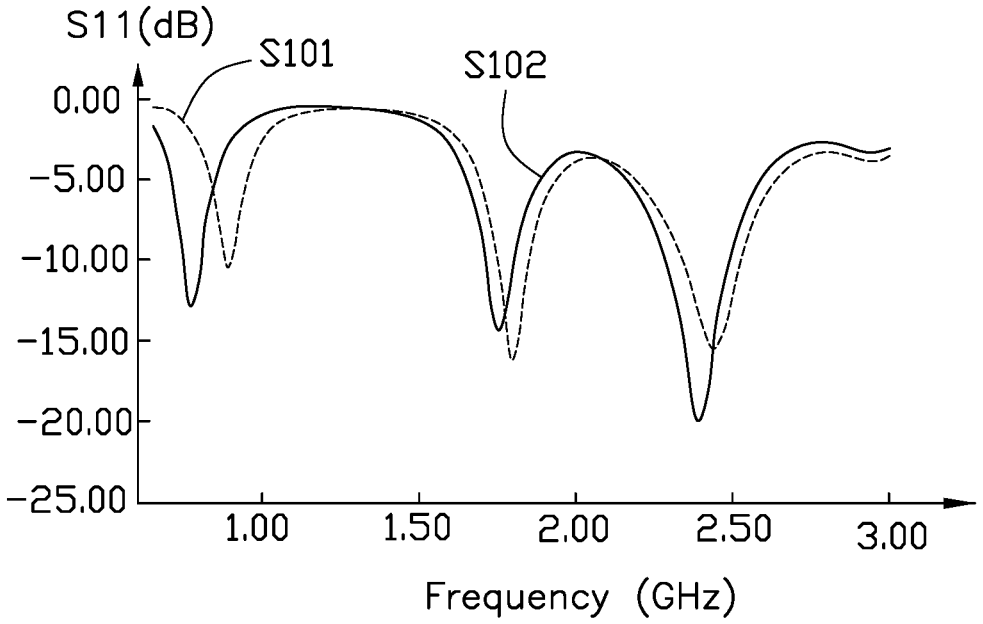
FIG. 10 is a scattering parameter graph of the antenna structure of FIG. 8.

FIG. 10 illustrates a scattering parameter graph of the antenna structure 300. Curve S101 illustrates a scattering parameter of the antenna structure 300 when the switcher SW switches to a second switching element 383 having a capacitance value of about 4 pF. Curve S102 illustrates a scattering parameter of the antenna structure 300 when the switcher SW switches to a second switching element 383 having a capacitance value of about 14 pF.

Figure 11:
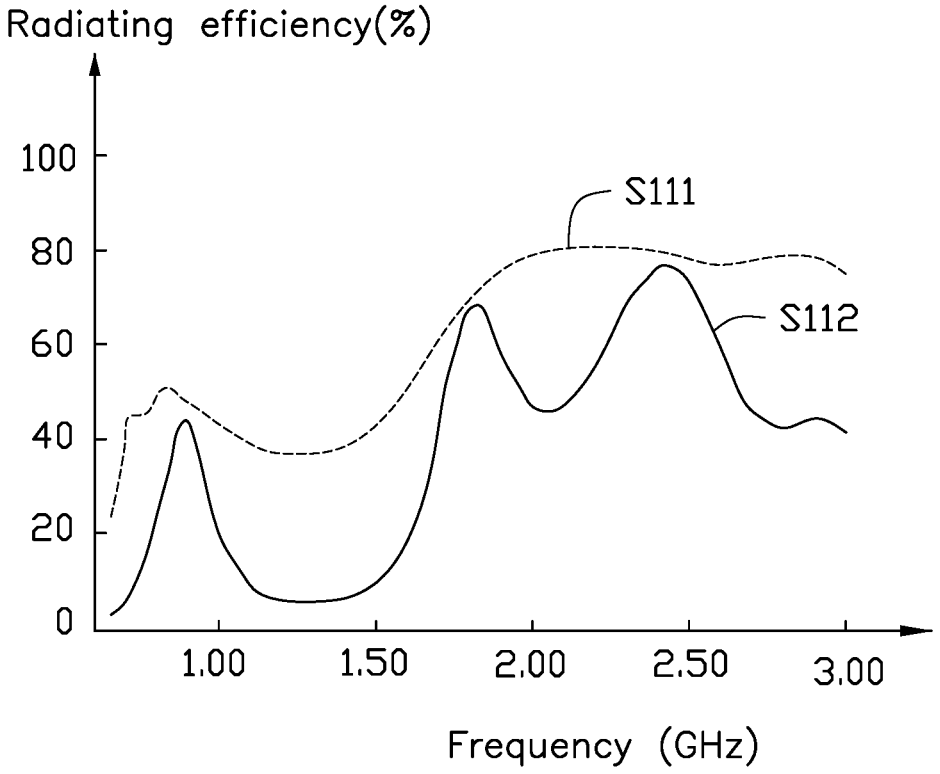
FIG. 11 is a radiating efficiency graph when a switcher of the antenna structure of FIG. 8 switches to a second switching element having a capacitance value of about 4 pF.

FIG. 11 illustrates a radiating efficiency graph of the antenna structure 300 when the switcher SW switches to a second switching element 383 having a capacitance value of about 4 pF. Curve S111 illustrates a radiating efficiency of the antenna structure 300 when the switcher SW switches to a second switching element 383 having a capacitance value of about 4 pF. Curve S112 illustrates a total radiating efficiency of the antenna structure 300 when the switcher SW switches to a second switching element 383 having a capacitance value of about 4 pF.

Figure 12:
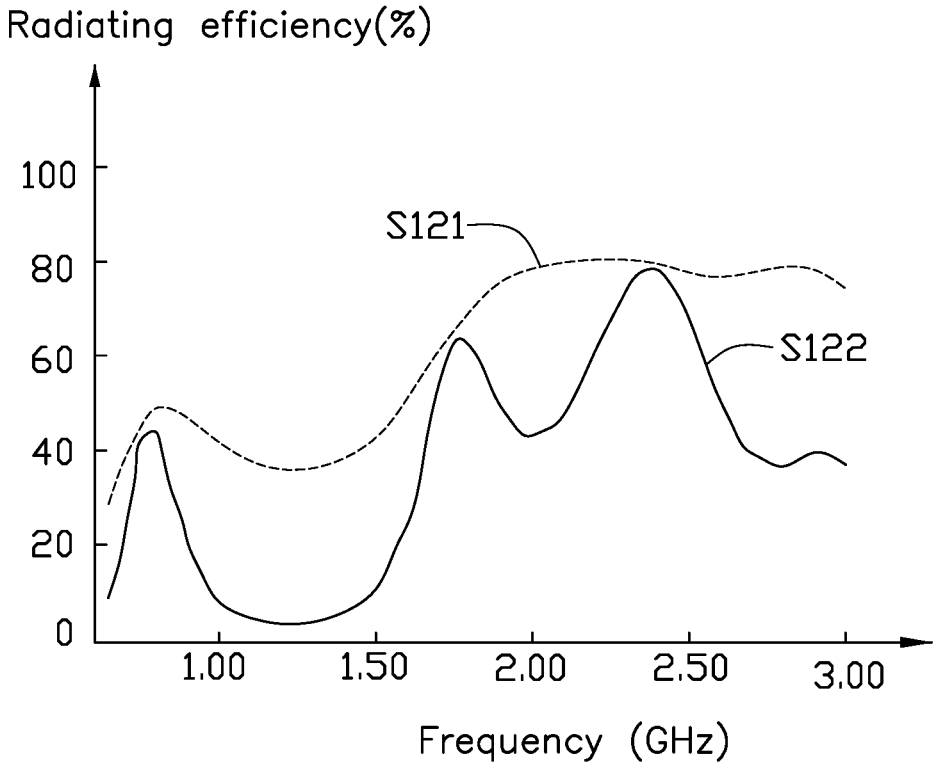
FIG. 12 is a radiating efficiency graph when a switcher of the antenna structure of FIG. 8 switches to a second switching element having a capacitance value of about 14 pF.

FIG. 12 illustrates a radiating efficiency graph of the antenna structure 300 when the switcher SW switches to a second switching element 383 having a capacitance value of about 14 pF. Curve S121 illustrates a radiating efficiency of the antenna structure 300 when the switcher SW switches to a second switching element 383 having a capacitance value of about 14 pF. Curve S122 illustrates a total radiating efficiency of the antenna structure 300 when the switcher SW switches to a second switching element 383 having a capacitance value of about 14 pF.

Figure 13:
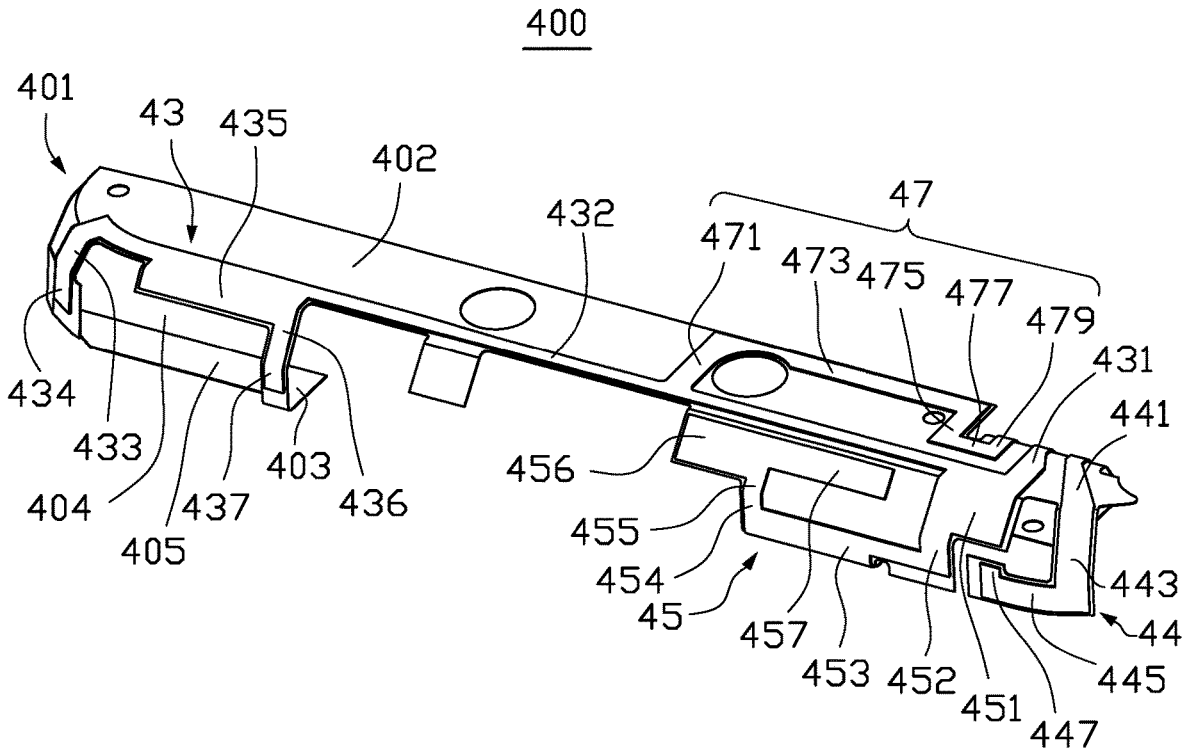
FIG. 13 is an isometric view of a third exemplary embodiment of an antenna structure.
Figure 14:
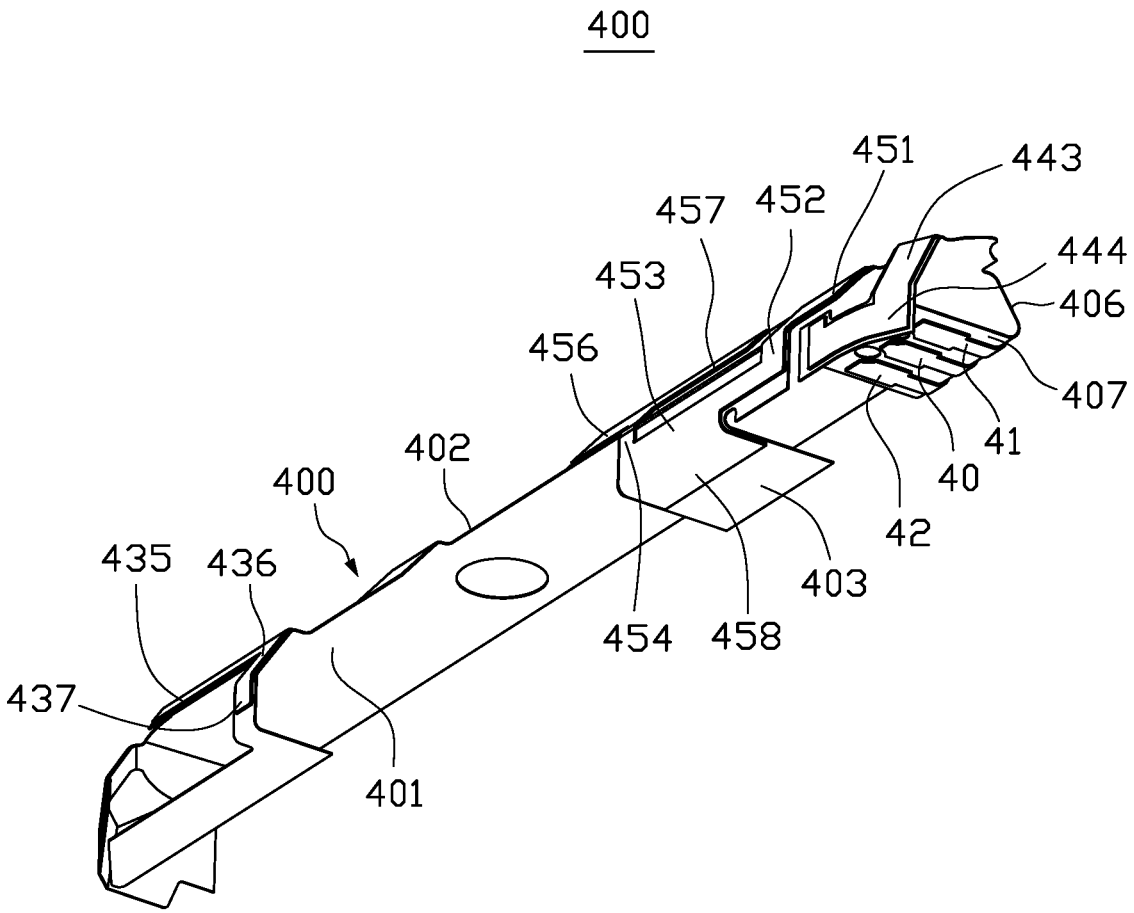
FIG. 14 is similar to FIG. 13, but shown from another angle.

FIGS. 13-14 illustrate a third exemplary embodiment of an antenna structure 400. The antenna structure 400 includes a feed portion 40, a first ground portion 41, a second ground portion 42, a first radiating portion 43, a second radiating portion 44, a third radiating portion 45, and an extension portion 47. The antenna structure 400 differs from the antenna structure 100 in that the antenna structure 400 does not includes the fourth radiating portion 16. That is, the fourth radiating portion 16 of the antenna structure 100 is omitted. Additionally, the antenna structure 400 further includes a base 401. Structures of the first radiating portion 43, the second radiating portion 44, the third radiating portion 45, and the extension portion 47 are different from the respective structures of the first radiating portion 13, the second radiating portion 14, the third radiating portion 15, and the extension portion 17 of the antenna structure 100.

In this exemplary embodiment, the base 401 is used to support the antenna structure 400. The base 401 includes a first surface 402, a second surface 403, a third surface 404, a fourth surface 405, a fifth surface 406, and a sixth surface 407. The first surface 402 is spaced apart from and parallel to the second surface 403. The third surface 404 forms a curved connection with one side of the first surface 402. One end of the fourth surface 405 forms a curved connection with the third surface 404. Another end of the fourth surface 405 is perpendicularly connected to the second surface 403. The fifth surface 406 is spaced apart from the third surface 404 and forms a curved connection with another side of the first surface 402 away from the third surface 404. The sixth surface 407 is spaced apart from and parallel to the first surface 402 and the second surface 403. The sixth surface 407 is positioned between the first surface 402 and the second surface 403. The sixth surface 407 further forms a curved connection with one side of the fifth surface 406 away from the first surface 402.

The feed portion 40 is substantially a strip. The feed portion 40 is positioned at the fifth surface 406 and extends to the sixth surface 407. The first ground portion 41 is spaced apart from the feed portion 40 and grounds the antenna structure 400.

The second ground portion 42 is substantially rectangular. The second ground portion 42 is positioned at the fifth surface 406 and extends to the sixth surface 407. The second ground portion 42 is positioned at one side of the feed portion 40 away from the first ground portion 41 and grounds the antenna structure 400.

The first radiating portion 43 is positioned at the first surface 402, the third surface 404, and the fourth surface 405. The first radiating portion 43 includes a first radiating section 431, a second radiating section 432, a third radiating section 433, a fourth radiating section 434, a fifth radiating section 435, a sixth radiating section 436, and a seventh radiating section 437.

The first radiating section 431 is substantially rectangular and is positioned at the first surface 402. The first radiating section 431 is electrically connected to one end of the feed portion 40 adjacent to the fifth surface 406 and extends along a direction towards the third surface 404. The second radiating section 432 is substantially rectangular and is coplanar with the first radiating section 431. One end of the second radiating section 432 is perpendicularly connected to one end of the first radiating section 431 away from the feed portion 40 and extends along a direction away from the first ground portion 41.

The third radiating section 433 is positioned at the third surface 404. One end of the third radiating section 433 forms a curved connection with one end of the second radiating section 432 away from the first radiating section 431. Another end of the third radiating section 433 extends towards the fourth surface 405. The fourth radiating section 434 is substantially rectangular and is positioned at the fourth surface 405. One end of the fourth radiating section 434 forms a curved connection with one end of the third radiating section 433 away from the second radiating section 432. Another end of the fourth radiating section 434 extends towards the second surface 403.

The fifth radiating section 435 is substantially rectangular and is positioned at the third surface 404. One end of the fifth radiating section 435 forms a curved connection with one side of the second radiating section 432 adjacent to the third radiating section 433 and opposite to the first radiating section 431. Another end of the fifth radiating section 435 extends towards the fourth surface 405.

The sixth radiating section 436 is substantially rectangular. The sixth radiating section 436 is coplanar with the fifth radiating section 435 and forms an L-shaped structure with the fifth radiating section 435. One end of the sixth radiating section 436 is perpendicularly connected to one side of the fifth radiating section 435 away from the second radiating section 432. Another end of the sixth radiating section 436 extends towards the fourth surface 405. In this exemplary embodiment, a width of the fifth radiating section 435 is larger than a width of the sixth radiating section 436.

The seventh radiating section 437 is substantially rectangular and is positioned at the fourth surface 405. One end of the seventh radiating section 437 forms a curved connection with one end of the sixth radiating section 436 away from the fifth radiating section 435. Another end of the seventh radiating section 437 extends towards the second surface 403.

The second radiating portion 44 includes a first coupling arm 441, a second coupling arm 443, a third coupling arm 445, and a fourth coupling arm 447. The first coupling arm 441 is substantially rectangular and is coplanar with the first radiating section 431. The first coupling arm 441 is electrically connected to one end of the first ground portion 11 and extends along a direction away from the first radiating section 431.

The second coupling arm 443 is positioned at the third surface 404. One end of the second coupling arm 443 forms a curved connection with one end of the first coupling arm 441 away from the first ground portion 41. Another end of the second coupling arm 443 extends towards the fourth surface 405. The third coupling arm 445 is substantially rectangular and is positioned at the fourth surface 405. One end of the third coupling arm 445 is perpendicularly connected to one end of the second coupling arm 443 away from the first coupling arm 441 and extends towards the seventh radiating section 437.

The fourth coupling arm 447 is substantially rectangular and is positioned at the fourth surface 405. The fourth coupling arm 447 is perpendicularly connected to one end of the third coupling arm 445 away from the second coupling arm 443 and extends along a direction parallel to the seventh radiating section 437 and towards the third surface 404.

The third radiating portion 45 includes a first radiating arm 451, a second radiating arm 452, a third radiating arm 453, a fourth radiating arm 454, a fifth radiating arm 455, a sixth radiating arm 456, a seventh radiating arm 457, and an eighth radiating arm 458. The first radiating arm 451 is substantially rectangular and is positioned at the third surface 404. One end of the first radiating arm 451 forms a curved connection with a junction of the first radiating section 431 and the second radiating section 432. Another end of the first radiating arm 451 extends along a direction parallel to the fifth radiating section 434 and towards the fourth surface 405.

The second radiating arm 452 is substantially rectangular and is positioned at the fourth surface 405. One end of the second radiating arm 452 forms a curved connection with one end of the first radiating arm 451 away from the second radiating section 432. Another end of the second radiating arm 452 extends along a direction parallel to the seventh radiating section 437 and towards the second surface 403. The third radiating arm 453 is substantially rectangular. One end of the third radiating arm 453 is perpendicularly connected to one end of the second radiating arm 452 away from the first radiating arm 451 and extends towards the seventh radiating section 437.

The fourth radiating arm 454 is substantially rectangular. One end of the fourth radiating arm 454 is perpendicularly connected to one end of the third radiating arm 453 away from the second radiating arm 452 and extends along a direction parallel to the second radiating arm 452 and towards the third surface 404. In this exemplary embodiment, the second radiating arm 452, the third radiating arm 453, and the fourth radiating arm 454 are coplanar with each other and form a U-shaped structure.

The fifth radiating arm 455 is substantially rectangular and is positioned at the third surface 404. One end of the fifth radiating arm 455 forms a curved connection with one end of the fourth radiating arm 454 away from the third radiating arm 453. Another end of the fifth radiating arm 455 extends along a direction parallel to the first radiating arm 451 and towards the first surface 402. The sixth radiating arm 456 is substantially rectangular and is coplanar with the fifth radiating arm 455. One end of the sixth radiating arm 456 is perpendicularly connected to one side of the fifth radiating arm 455 away from the first radiating arm 451. Another end of the sixth radiating arm 456 extends along a direction away from the first radiating arm 451.

The seventh radiating arm 457 is substantially rectangular and is coplanar with the sixth radiating arm 456. One end of the seventh radiating arm 457 is perpendicularly connected to one side of the fifth radiating arm 455 away from the sixth radiating arm 456. Another end of the seventh radiating arm 457 extends towards the first radiating arm 451. In this exemplary embodiment, a width of the sixth radiating arm 456 is larger than a width of the seventh radiating arm 457. The sixth radiating arm 456 is shorter than the seventh radiating arm 457. The eighth radiating arm 458 is substantially rectangular and is positioned at the second surface 403. The eighth radiating arm 458 is perpendicularly connected to one side of the third radiating arm 453 away from the second radiating arm 452 and the fourth radiating arm 454.

The extension portion 47 is positioned at the first surface 402. The extension portion 47 includes a first extension section 471, a second extension section 473, a third extension section 475, a fourth extension section 477, and a fifth extension section 479, connected in that order.

The first extension section 471 is substantially rectangular. The first extension section 471 is perpendicularly connected to one side of the second radiating section 432 adjacent to the first radiating section 431 and extends along a direction parallel to the first radiating section 431 towards the fifth surface 406.

The second extension section 473 is substantially rectangular. One end of the second extension section 473 is perpendicularly connected to one end of the first extension section 471 away from the second radiating section 432. Another end of the second extension section 473 extends along a direction parallel to the second radiating section 432 and towards the first radiating section 431. The third extension section 475 is substantially rectangular. One end of the third extension section 475 is perpendicularly connected to one end of the second extension section 473 away from the first extension section 471. Another end of the third extension section 475 extends along a direction parallel to the first extension section 471 and towards the second radiating section 432.

The fourth extension section 477 is substantially rectangular. The fourth extension section 477 is perpendicularly connected to one end of the third extension section 475 away from the second extension section 473 and extends along a direction parallel to the second extension section 473 and towards the first radiating section 431. The fifth extension section 479 is substantially rectangular. The fifth extension section 479 is perpendicularly connected to one end of the fourth extension section 477 away from the third extension section 475 and extends along a direction parallel to the first radiating section 431 and away from the second radiating section 432 until a point where the fifth extension section 479 is connected to the second ground portion 42.

In this exemplary embodiment, the first extension section 471 is longer than the first radiating section 431. The third extension section 475 is shorter than the first extension section 471. The fourth extension section 477 is shorter than the second extension section 473. The fifth extension section 479 is shorter than the third extension section 475.

Figure 15:
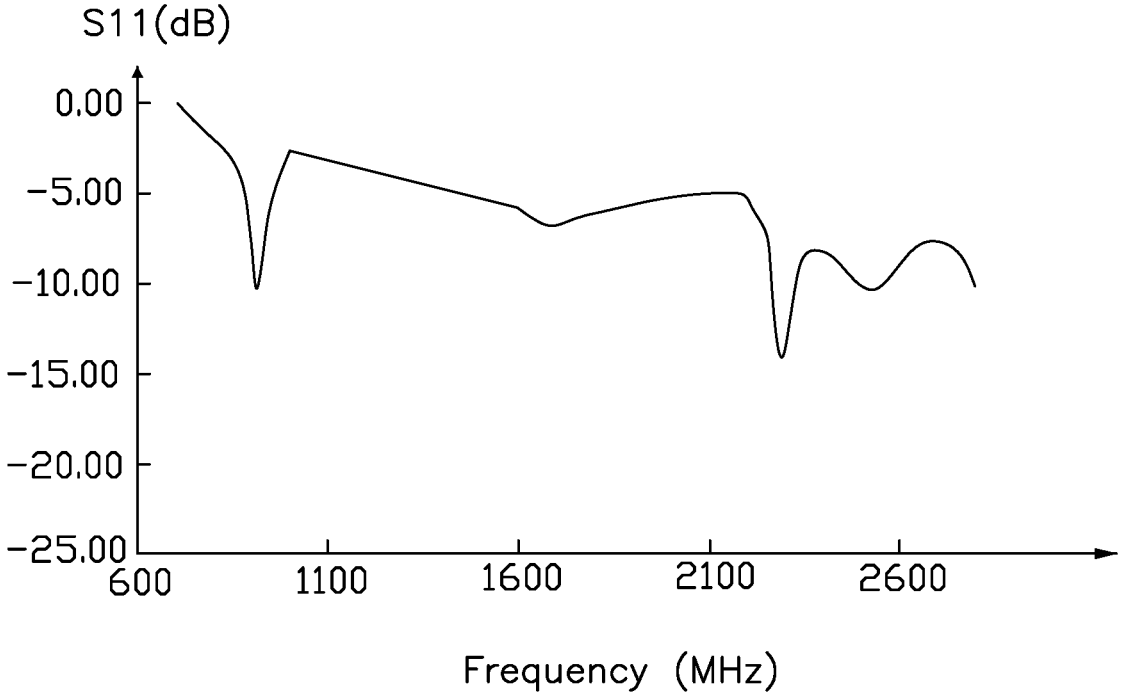
FIG. 15 is a scattering parameter graph of the antenna structure of FIG. 13.
Figure 16:
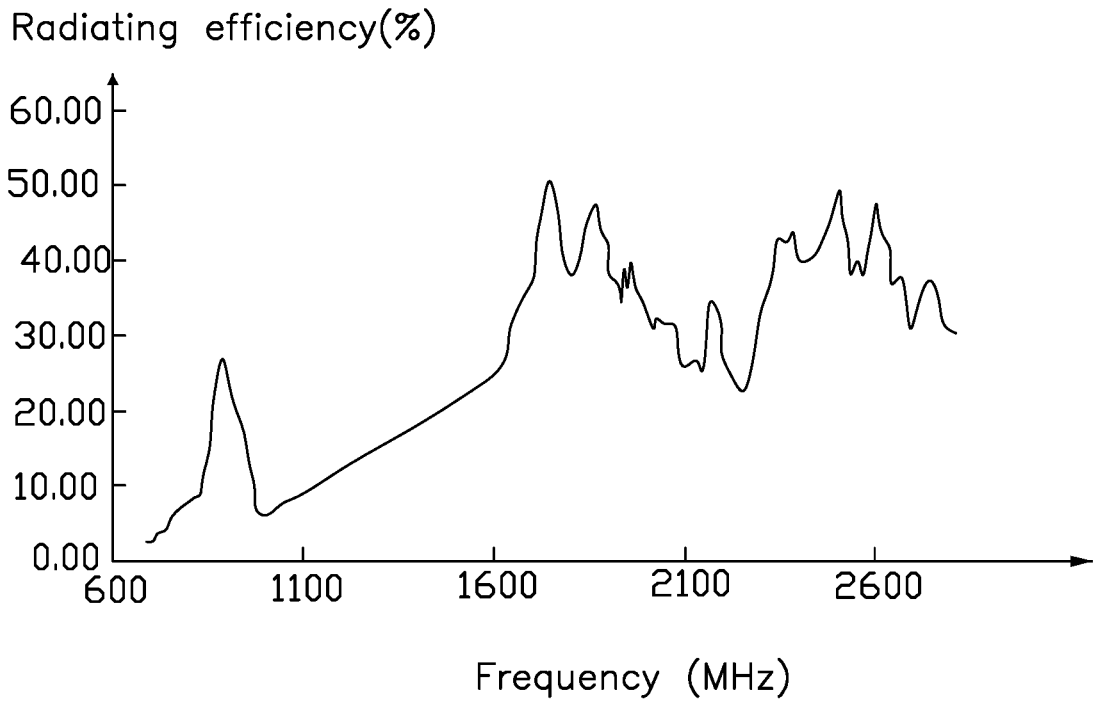
FIG. 16 is a radiating efficiency graph of the antenna structure of FIG. 13.

FIG. 15 illustrates a scattering parameter graph of the antenna structure 400. FIG. 16 illustrates a radiating efficiency graph of the antenna structure 400. FIGS. 15-16 show that a low frequency band of the antenna structure 400 covers 880-960 MHz, middle and high frequency bands of the antenna structure 400 cover 1710-2170 MHz, which satisfies a design of the antenna and supports CA technology.

In other exemplary embodiments, the antenna structure 400 can include a switching circuit 19 (as in FIG. 4) at the second ground portion 42, then the low frequency band of the antenna structure 400 can cover 700-960 MHz.

The embodiments shown and described above are only examples. Many details are often found in the art such as the other features of the antenna structure and the wireless communication device. Therefore, many such details are neither shown nor described. Even though numerous characteristics and advantages of the present technology have been set forth in the foregoing description, together with details of the structure and function of the present disclosure, the disclosure is illustrative only, and changes may be made in the details, especially in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. An antenna structure comprising:

a feed portion, the feed portion configured to feed current to the antenna structure;

a first ground portion, the first ground portion spaced apart from the feed portion and configured to ground the antenna structure;

a first radiating portion, the first radiating portion electrically connected to the feed portion;

a second radiating portion, the second radiating portion spaced apart from the first radiating portion and electrically connected to the first ground portion; and a third radiating portion, the third radiating portion spaced apart from the second radiating portion and electrically connected to the feed portion and the first radiating portion;

wherein the first radiating portion comprises a first radiating section, a second radiating section, a third radiating section, and a fourth radiating section, the first radiating section is positioned at a plane perpendicular to a plane on which the feed portion is positioned, the first radiating section is electrically connected to one end of the feed portion; wherein the second radiating section is coplanar with the first radiating section, the second radiating section is perpendicularly connected to one end of the first radiating section away from the feed portion and extends along a direction away from the second radiating portion; wherein one end of the third radiating section is electrically connected to one end of the second radiating section away from the first radiating section; wherein the fourth radiating section is positioned at a plane perpendicular to a plane on which the second radiating section is positioned, the fourth radiating section is electrically connected to one end of the third radiating section away from the second radiating section.

2. The antenna structure of claim 1, wherein wherein one end of the third radiating section forms a curved connection with one end of the second radiating section away from the first radiating section, another end of the third radiating section extends along a direction parallel to the feed portion, then extends along a direction parallel to the second radiating section and away from the first radiating section and the second radiating section; wherein one end of the fourth radiating section forms a curved connection with one end of the third radiating section away from the second radiating section, and another end of the fourth radiating section extends along a direction away from the second radiating section.

3. The antenna structure of claim 2, wherein the second radiating portion comprises a first coupling arm, a second coupling arm, a third coupling arm, a fourth coupling arm, and a fifth coupling arm; wherein the first coupling arm is coplanar with the first radiating section, the first coupling arm is perpendicularly connected to one end of the first ground portion and extends along a direction parallel to the first radiating section; wherein one end of the second coupling arm forms a curved connection with one end of the first coupling arm away from the first ground portion, another end of the second coupling arm extends along a direction parallel to the third radiating section; wherein the third coupling arm, the fourth coupling arm, the fifth coupling arm, and the fourth radiating section are coplanar with each other, the third coupling arm forms a curved connection with one end of the second coupling arm away from the first coupling arm and extends along a direction parallel to the fourth radiating section; wherein the fourth coupling arm is perpendicularly connected to one end of the third coupling arm away from the second coupling arm and extends towards the fourth radiating section; wherein the fifth coupling arm is perpendicularly connected to one end of the fourth coupling arm away from the third coupling arm and extends along a direction parallel to the third coupling arm and towards the second radiating section.

4. The antenna structure of claim 3, wherein the third radiating portion comprises a first radiating arm and a second radiating arm, the first radiating arm is coplanar with the second coupling arm, one end of the first radiating arm forms a curved connection with a junction of the first radiating section and the second radiating section, another end of the first radiating arm extends along a direction parallel to the second coupling arm; wherein the second radiating arm is positioned at a plane parallel to a plane on which the second radiating section is positioned, one end of the second radiating arm is perpendicularly connected to one end of the first radiating arm away from the first radiating section and extends along a direction parallel to the second radiating section and towards the fourth radiating section.

5. The antenna structure of claim 3, further comprising a fourth radiating portion, wherein the fourth radiating portion is coplanar with the first radiating section, one end of the fourth radiating portion is perpendicularly connected to one side of the first radiating section adjacent to the second radiating section and away from the first coupling arm, another end of the fourth radiating portion extends along a direction parallel to the second radiating section and away from the second radiating portion.

6. The antenna structure of claim 5, further comprising a second ground portion and an extension portion, wherein the second ground portion is positioned at one side of the feed portion away from the first ground portion to ground the antenna structure; wherein the extension portion comprises a first extension section and a second extension section, the first extension section is coplanar with the first radiating section, the first extension section is perpendicularly connected to a middle portion of one side of the second radiating section and extends along a direction parallel to the first radiating section; wherein the second extension section is perpendicularly connected to one end of the first extension section away from the second radiating section and extends along a direction parallel to the second radiating section and towards the first radiating section until the second extension section is perpendicularly connected to the second ground portion.

7. The antenna structure of claim 2, further comprising a matching circuit, wherein the matching circuit comprises a first matching element and a second matching element, one end of the first matching element is electrically connected to a feed source, another end of the first matching element is electrically connected to one end of the second matching element and the feed portion, another end of the second matching element is grounded.

8. The antenna structure of claim 6, further comprising a switching circuit, wherein the switching circuit comprises a switching unit and a plurality of first switching elements, the switching unit is electrically connected to the second ground portion, the first switching elements are connected in parallel, one end of each first switching element is electrically connected to the switching unit, and the other end of each first switching element is grounded; wherein through controlling the switching unit, the switching unit switches to connect with different first switching elements to adjust a low frequency band of the antenna structure.

9. The antenna structure of claim 1, wherein the third radiating section is coplanar with the first radiating section and the second radiating section, one end of the third radiating section is perpendicularly connected to one end of the second radiating section away from the first radiating section, another end of the third radiating section extends along a direction parallel to and away from the first radiating section, then extends along a direction parallel to the second radiating section and away from the first radiating section; wherein the fourth radiating section is perpendicularly connected to one end of the third radiating section away from the second radiating section.

10. The antenna structure of claim 9, wherein the second radiating portion comprises a first coupling arm, a second coupling arm, a third coupling arm, and a fourth coupling arm, the first coupling arm is coplanar with the first radiating section, the first coupling arm is perpendicularly connected to one end of the first ground portion and extends along a direction parallel to the first radiating section; wherein the second coupling arm, the third coupling arm, the fourth coupling arm, and the fourth radiating section are coplanar with each other, the second coupling arm is perpendicularly connected to one end of the first coupling arm away from the first ground portion and extends along a direction parallel to the fourth radiating section; wherein the third coupling arm is perpendicularly connected to one end of the second coupling arm away from the first coupling arm and extends along a direction towards the fourth radiating section; wherein the fourth coupling arm is perpendicularly connected to one end of the third coupling arm away from the second coupling arm and extends along a direction parallel to the second coupling arm and towards the second radiating section.

11. The antenna structure of claim 10, wherein the third radiating portion comprises a first radiating arm and a second radiating arm, the first radiating arm is coplanar with the first radiating section; wherein one end of the first radiating arm is perpendicularly connected to a junction of the first radiating section and the second radiating section, another end of the first radiating arm extends along a direction parallel to the first coupling arm and away from the first radiating section; wherein the second radiating arm is positioned at a plane parallel to a plane on which the feed portion is positioned, the second radiating arm is perpendicularly connected to one end of the first radiating arm away from the first radiating section and extends along a direction parallel to the third coupling arm and towards the fourth radiating section.

12. The antenna structure of claim 9, further comprising a matching circuit, wherein the matching circuit comprises a first matching element, a switcher, and a plurality of second switching elements, one end of the first matching element is electrically connected to a feed source and one end of the switcher, another end of the first matching element is grounded, the second switching elements are connected in parallel, one end of each second switching element is electrically connected to another end of the switcher, and the other end of each second switching element is electrically connected to the feed portion; wherein through controlling the switcher, the feed portion is switched to connect with different second switching elements to adjust a low frequency band of the antenna structure.

13. A wireless communication device comprising:

an antenna structure comprising:

a feed portion, the feed portion configured to feed current to the antenna structure;

a first ground portion, the first ground portion spaced apart from the feed portion and configured to ground the antenna structure;

a first radiating portion, the first radiating portion electrically connected to the feed portion;

a second radiating portion, the second radiating portion spaced apart from the first radiating portion and electrically connected to the first ground portion; and a third radiating portion, the third radiating portion spaced apart from the second radiating portion and electrically connected to the feed portion and the first radiating portion;

wherein the first radiating portion comprises a first radiating section, a second radiating section, a third radiating section, and a fourth radiating section, the first radiating section is positioned at a plane perpendicular to a plane on which the feed portion is positioned, the first radiating section is electrically connected to one end of the feed portion; wherein the second radiating section is coplanar with the first radiating section, the second radiating section is perpendicularly connected to one end of the first radiating section away from the feed portion and extends along a direction away from the second radiating portion; wherein one end of the third radiating section is electrically connected to one end of the second radiating section away from the first radiating section; wherein the fourth radiating section is positioned at a plane perpendicular to a plane on which the second radiating section is positioned, the fourth radiating section is electrically connected to one end of the third radiating section away from the second radiating section.

14. The wireless communication device of claim 13, further comprising a housing, wherein the housing comprises a bottom board and a side frame, the side frame surrounds a periphery of the bottom board; wherein the bottom board and the side frame cooperatively form a receiving space to receive the antenna structure.

15. The wireless communication device of claim 14, further comprises a keep-out-zone, a vibrator, a speaker module, a Universal Serial Bus (USB) interface module, and a battery; wherein the keep-out-zone is received in the receiving space, the vibrator is spaced apart from the speaker module, the vibrator and the speaker module are both adjacent to the keep-out-zone, the USB interface module is positioned between the vibrator and the speaker module, and the USB interface module is positioned above the keep-out-zone; wherein the battery is positioned at one side of the vibrator and the speaker module away from the keep-out-zone; and wherein the antenna structure is positioned above the keep-out-zone.

16. An antenna structure comprising:

a feed portion, the feed portion configured to feed current to the antenna structure;

a first ground portion, the first ground portion spaced apart from the feed portion and configured to ground the antenna structure;

a first radiating portion, the first radiating portion electrically connected to the feed portion;

a second radiating portion, the second radiating portion spaced apart from the first radiating portion and electrically connected to the first ground portion;

a third radiating portion, the third radiating portion spaced apart from the second radiating portion and electrically connected to the feed portion and the first radiating portion; and a base, wherein the base comprises a first surface, a second surface, a third surface, a fourth surface, a fifth surface, and a sixth surface; wherein the first surface is spaced apart from and parallel to the second surface, the third surface forms a curved connection with one side of the first surface, one end of the fourth surface forms a curved connection with the third surface, another end of the fourth surface is perpendicularly connected to the second surface, the fifth surface is spaced apart from the third surface and forms a curved connection with another side of the first surface away from the third surface, the sixth surface is spaced apart from and parallel to the first surface and the second surface, the sixth surface is positioned between the first surface and the second surface, the sixth surface further forms a curved connection with one side of the fifth surface away from the first surface; wherein the feed portion and the first ground portion are both positioned at the fifth surface and the sixth surface, the first radiating portion and the second radiating portion are both positioned at the first surface, the third surface, and the fourth surface; wherein the third radiating portion is positioned at the first surface, the second surface, the third surface, and the fourth surface.

17. The antenna structure of claim 16, wherein the first radiating portion comprises a first radiating section, a second radiating section, a third radiating section, a fourth radiating section, a fifth radiating section, a sixth radiating section, and a seventh radiating section; wherein the first radiating section is positioned at the first surface, the first radiating section is electrically connected to one end of the feed portion adjacent to the fifth surface and extends along a direction towards the third surface; wherein the second radiating section is coplanar with the first radiating section, the second radiating section is perpendicularly connected to one end of the first radiating section away from the feed portion and extends along a direction away from the first ground portion; wherein the third radiating section is positioned at the third surface, one end of the third radiating section forms a curved connection with one end of the second radiating section away from the first radiating section, and another end of the third radiating section extends towards the fourth surface; wherein the fourth radiating section is positioned at the fourth surface, one end of the fourth radiating section forms a curved connection with one end of the third radiating section away from the second radiating section, another end of the fourth radiating section extends towards the second surface; the fifth radiating section is positioned at the third surface, one end of the fifth radiating section forms a curved connection with one side of the second radiating section adjacent to the third radiating section and opposite to the first radiating section, another end of the fifth radiating section extends towards the fourth surface; wherein the sixth radiating section is coplanar with the fifth radiating section and forms an L-shaped structure with the fifth radiating section, the sixth radiating section is perpendicularly connected to one side of the fifth radiating section away from the second radiating section and extends towards the fourth surface; wherein the seventh radiating section is positioned at the fourth surface, one end of the seventh radiating section forms a curved connection with one end of the sixth radiating section away from the fifth radiating section, and another end of the seventh radiating section extends towards the second surface.

18. The antenna structure of claim 17, wherein the second radiating portion comprises a first coupling arm, a second coupling arm, a third coupling arm, and a fourth coupling arm, the first coupling arm is coplanar with the first radiating section, the first coupling arm is electrically connected to one end of the first ground portion and extends along a direction away from the first radiating section; wherein the second coupling arm is positioned at the third surface, one end of the second coupling arm forms a curved connection with one end of the first coupling arm away from the first ground portion, another end of the second coupling arm extends towards the fourth surface; wherein the third coupling arm is positioned at the fourth surface, one end of the third coupling arm is perpendicularly connected to one end of the second coupling arm away from the first coupling arm and extends towards the seventh radiating section; wherein the fourth coupling arm is positioned at the fourth surface, the fourth coupling arm is perpendicularly connected to one end of the third coupling arm away from the second coupling arm and extends along a direction parallel to the seventh radiating section and towards the third surface.

19. The antenna structure of claim 18, wherein the third radiating portion comprises a first radiating arm, a second radiating arm, a third radiating arm, a fourth radiating arm, a fifth radiating arm, a sixth radiating arm, a seventh radiating arm, and an eighth radiating arm, the first radiating arm is positioned at the third surface, one end of the first radiating arm forms a curved connection with a junction of the first radiating section and the second radiating section, another end of the first radiating arm extends along a direction parallel to the fifth radiating section and towards the fourth surface; wherein the second radiating arm is positioned at the fourth surface, one end of the second radiating arm forms a curved connection with one end of the first radiating arm away from the second radiating section, another end of the second radiating arm extends along a direction parallel to the seventh radiating section and towards the second surface; wherein the third radiating arm is perpendicularly connected to one end of the second radiating arm away from the first radiating arm and extends towards the seventh radiating section; wherein the fourth radiating arm is perpendicularly connected to one end of the third radiating arm away from the second radiating arm and extends along a direction parallel to the second radiating arm and towards the third surface; wherein the fifth radiating arm is positioned at the third surface, one end of the fifth radiating arm forms a curved connection with one end of the fourth radiating arm away from the third radiating arm, another end of the fifth radiating arm extends along a direction parallel to the first radiating arm and towards the first surface; wherein the sixth radiating arm is coplanar with the fifth radiating arm, the sixth radiating arm is perpendicularly connected to one side of the fifth radiating arm away from the first radiating arm and extends away from the first radiating arm; wherein the seventh radiating arm is coplanar with the sixth radiating arm, the seventh radiating arm is perpendicularly connected to one side of the fifth radiating arm away from the sixth radiating arm and extends towards the first radiating arm; wherein the eighth radiating arm is positioned at the second surface, the eighth radiating arm is perpendicularly connected to one side of the third radiating arm away from the second radiating arm and the fourth radiating arm.

20. The antenna structure of claim 17, further comprising a second ground portion and an extension portion, wherein the second ground portion is positioned at the fifth surface and the sixth surface, the second ground portion is spaced apart from the feed portion and the first ground portion; wherein the extension portion is positioned at the first surface and comprises a first extension section, a second extension section, a third extension section, a fourth extension section, and a fifth extension section; wherein the first extension section is perpendicularly connected to one side of the second radiating section adjacent to the first radiating section and extends along a direction parallel to the first radiating section and towards the fifth surface; wherein the second extension section is perpendicularly connected to one end of the first extension section away from the second radiating section and extends along a direction parallel to the second radiating section and towards the first radiating section; wherein the third extension section is perpendicularly connected to one end of the second extension section away from the first extension section and extends along a direction parallel to the first extension section and towards the second radiating section; wherein the fourth extension section is perpendicularly connected to one end of the third extension section away from the second extension section and extends along a direction parallel to the second extension section and towards the first radiating section; wherein the fifth extension section is perpendicularly connected to one end of the fourth extension section away from the third extension section and extends along a direction parallel to the first radiating section and away from the second radiating section until the fifth extension section is connected to the second ground portion.

* * * * *